US009487351B2

(12) United States Patent
Barnes

(10) Patent No.: US 9,487,351 B2
(45) Date of Patent: Nov. 8, 2016

(54) MODIFIABLE CONTAINERS AND INTERCONNECTORS

(71) Applicant: JOINTAINER, LLC, Morristown, NJ (US)

(72) Inventor: Andrew Barnes, Hubbardsville, NY (US)

( * ) Notice: Subject to any disclaimer, the term of this patent is extended or adjusted under 35 U.S.C. 154(b) by 0 days.

(21) Appl. No.: 14/124,507

(22) PCT Filed: Jul. 23, 2013

(86) PCT No.: PCT/US2013/051740

§ 371 (c)(1),
(2) Date: Dec. 6, 2013

(87) PCT Pub. No.: WO2014/018566

PCT Pub. Date: Jan. 30, 2014

(65) Prior Publication Data

US 2016/0023844 A1 Jan. 28, 2016

Related U.S. Application Data

(60) Provisional application No. 61/741,549, filed on Jul. 23, 2012.

(51) Int. Cl.
*B65D 90/00* (2006.01)
*B65D 88/02* (2006.01)

(52) U.S. Cl.
CPC ..... *B65D 90/0013* (2013.01); *B65D 88/022* (2013.01); *B65D 90/0006* (2013.01)

(58) Field of Classification Search
CPC ..... B65D 90/0006; B65D 90/0013; B65D 90/002; B65D 88/022; B65D 88/027; Y10T 24/28
See application file for complete search history.

(56) References Cited

U.S. PATENT DOCUMENTS 3,317,219 A * 5/1967 Hindin ..... B60P 1/6481 220/1.5
3,578,374 A * 5/1971 Glassmeyer ..... B65D 90/0006 220/23.4
3,601,866 A * 8/1971 Odin ..... B63B 25/28 24/287
4,049,149 A * 9/1977 Durenec ..... B60P 7/132 220/23.4
4,431,368 A * 2/1984 Katz ..... B60P 1/6481 280/408
4,591,307 A * 5/1986 Clive-Smith ..... B60P 7/132 24/287
4,641,399 A * 2/1987 Jackson ..... B65D 90/0006 24/287
4,695,184 A * 9/1987 Robishaw ..... B60P 7/13 114/249
4,819,820 A * 4/1989 Weiner ..... B65D 88/022 220/1.5
5,012,560 A * 5/1991 Janke ..... B65D 90/0013 24/287
5,816,423 A * 10/1998 Fenton ..... B65D 88/121 220/1.5
6,364,584 B1 * 4/2002 Taylor ..... B65D 88/022 410/121
2003/0006233 A1 * 1/2003 Reynard ..... B65D 90/0006 220/23.4
2003/0175089 A1 * 9/2003 Almind ..... B65D 88/005 410/2
2004/0028495 A1 * 2/2004 Tomkins ..... B65D 88/022 410/46
2006/0113302 A1 * 6/2006 Mandava ..... B65D 88/129 220/1.5
2006/0115350 A1 * 6/2006 Weis ..... B65D 90/002 414/139.4
2007/0271857 A1 * 11/2007 Heather ..... B65D 88/005 52/79.9
2008/0179319 A1 * 7/2008 Nielsen ..... B65D 88/022 220/1.5
2014/0178171 A1 * 6/2014 Herold ..... B65D 90/00 414/802
2014/0359977 A1 * 12/2014 Bean ..... B65D 90/0013 24/287

* cited by examiner

*Primary Examiner* — Elizabeth A Quast

(74) *Attorney, Agent, or Firm* — James M. Smedley LLC; James Michael Smedley, Esq.

(57) ABSTRACT

The present invention relates to the field of shipping containers. Specifically, the present invention provides for an apparatus for enabling two non-standard shipping containers to be interconnected to form a standard shipping container.

10 Claims, 10 Drawing Sheets

MODIFIABLE CONTAINERS AND INTERCONNECTORS

CROSS-REFERENCE TO RELATED APPLICATIONS

This application claims the benefit of the following provisional application, which is hereby incorporated by reference in its entirety: U.S. Pat. App. No. 61/741,549 filed on Jul. 23, 2012 and entitled "Modifiable Containers and Interconnectors".

This application claims the benefit of the following patent application, which is hereby incorporated by reference in its entirety: PCT/US2013/051740 filed on Jul. 23, 2013 and entitled "Modifiable Containers and Interconnectors".

FIELD OF THE INVENTION

The present invention relates generally to shipping containers modification apparatuses. Specifically, embodiments of the present invention are directed towards an apparatus for enabling two non-standard shipping containers to be interconnected to form a standard shipping container.

BACKGROUND

The present invention relates to shipping containers which can be modified to enable smaller containers to be interconnected together to form a single larger container having a volume substantially equal to that of the two smaller containers.

The shipping containers intended for use in practicing the invention include containers which are used for transporting various cargo items primarily by ship, truck, and/or rail. By way of example, the containers may be approximately eight feet high and eight feet wide with lengths of twenty (20) and forty (40) feet.

As a general rule, shipping containers enjoy a minimum cost per cubic foot if the container is a standard length since ship and truck handling and storage equipment are designed to handle the standard length. By way of example, assume that the standard length is selected to be forty (40) feet, and containers that are forty (40) feet in length will be referred to herein as standard shipping containers or standard containers. Containers which are smaller in length than forty (40) feet will be referred to herein as non-standard shipping containers or non-standard containers. To provide standard containers for economic shipping and to handle certain cargo, it is desirable to join multiple non-standard (e.g., a smaller, twenty (20) foot length) containers to form a single standard container.

However, to interconnect non-standard containers to form a standard container is problematic. One problem pertains to the interconnection of two (or more) non-standard length containers to form a sturdy, reliable and easily operable structural connection which can firmly hold the non-standard containers together. Another problem pertains to the manufacture of non-standard containers which can be modified so they can be selectively joined to form a single larger standard container.

Therefore, there is a need in the art for an apparatus that provides a sturdy and reliable means by which to connect non-standard shipping containers together to form the equivalent of a standard shipping container. These and other features and advantages of the present invention will be explained and will become obvious to one skilled in the art through the summary of the invention that follows.

SUMMARY OF THE INVENTION

Accordingly, it is an embodiment of the present invention to provide a shipping container with a redesigned frame and hinged end panel, as well as a connection means that enables a multiple non-standard containers to be coupled together to form a container that is in equivalent size as standard shipping container. Similarly, it enables a standard shipping container formed from non-standard shipping containers to be broken down into a number of non-standard shipping containers. This enables the shipping of both standard and non-standard shipping containers, depending on what is most advantageous in a given situation.

Thus, as an illustrative example, a standard (e.g., 40 foot) shipping container can be used to form two non-standard (e.g., 20 foot) shipping containers. This would be advisable, for example, where the contents and/or destination of the goods in the large container so warrant. On the other hand, where two non-standard shipping containers have to be shipped to the same location, there is a significant saving in shipping cost by shipping a single standard shipping container rather than two non-standard shipping containers. This is because, as noted above, it is much more expensive to ship two non-standard containers than one standard container.

According to an embodiment of the present invention, an apparatus for modifying shipping containers, the apparatus comprising: a connectable end frame, comprising a top cross bar, a first frame upright, a second frame upright, and a bottom cross bar, wherein the top cross connects the top of the first frame upright to the top of the second frame upright, wherein the bottom cross bar connects the bottom of the first frame upright to the bottom of the second frame upright, wherein the connectable end frame is configured with one or more connection points, and one or more connector mechanisms, wherein each of the one or more connector mechanisms reversibly engages with one or more of the one or more connection points.

According to an embodiment of the present invention, an apparatus for modifying shipping containers further comprising one or more connection flaps, wherein the one or more connection flaps are used to connect the first frame upright and the second frame upright of a first shipping container to the first frame upright and the second frame upright of a second shipping container.

According to an embodiment of the present invention, the connector mechanism is a twist-lock apparatus.

According to an embodiment of the present invention, the connector mechanism is a connector strap.

According to an embodiment of the present invention, connector strap is further comprised of a secondary locking mechanism.

According to an embodiment of the present invention, the secondary locking mechanism is further comprised of one or more locking hooks.

According to an embodiment of the present invention, the secondary locking mechanism is further comprised of a locking hook engagement handle.

According to an embodiment of the present invention, the connector strap is further comprised of a liquid diverting system.

According to an embodiment of the present invention, the liquid diverting system is further comprised of a liquid diverting ledge.

According to an embodiment of the present invention, the liquid diverting system is further comprised of a liquid draining slit.

According to an embodiment of the present invention, the connectable end frame may be further comprised of rubber tubing attached to one or more of the first frame upright, the second frame upright, the top cross bar and the bottom cross bar.

According to an embodiment of the present invention, the one or more hinges for an end panel may be attached to one or more frame uprights selected from a group of frame uprights comprising the first frame upright and the second frame upright.

According to an embodiment of the present invention, the bottom cross bar of the connectable end frame is further configured with a floor extension plate.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
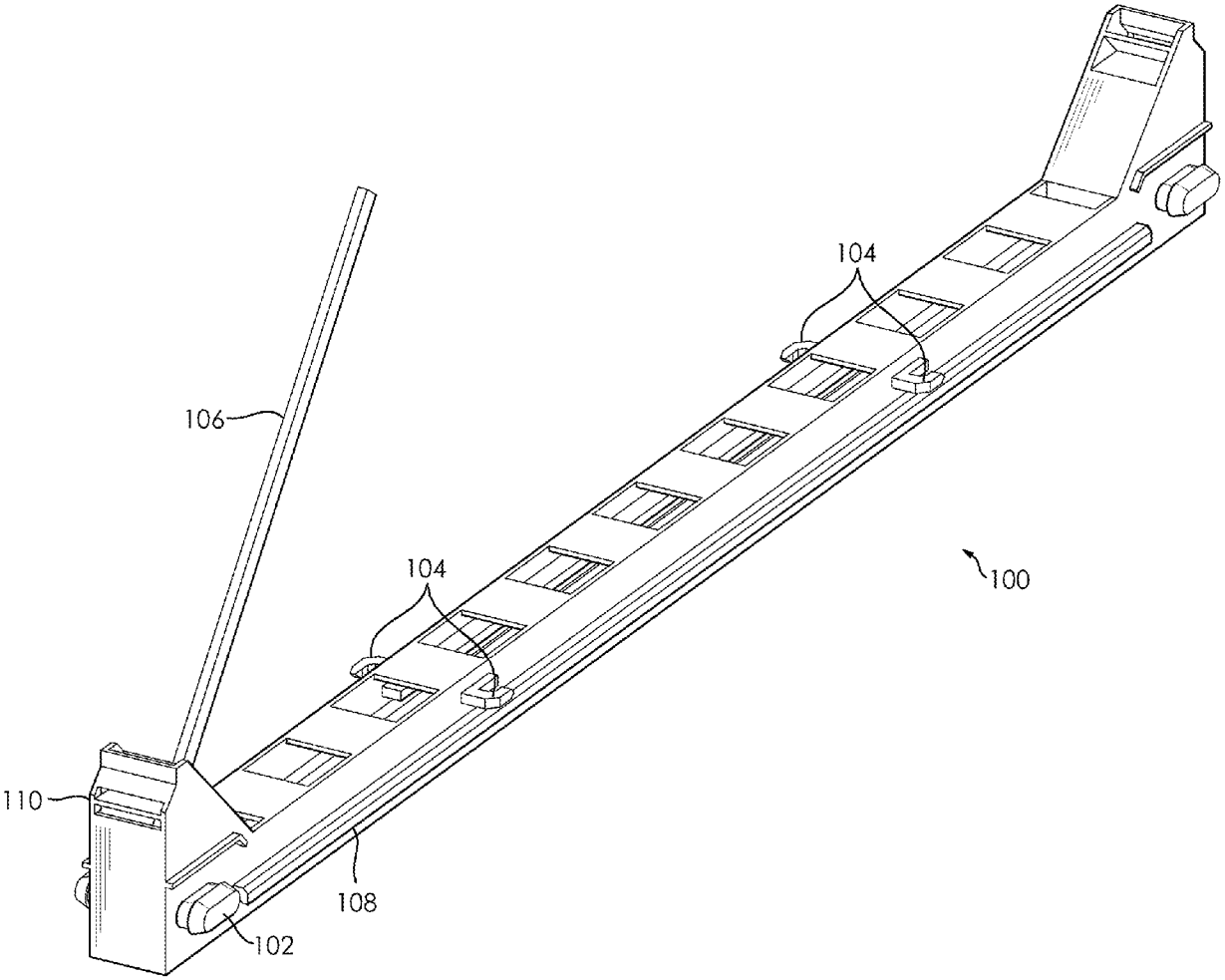
FIG. 1 is a perspective view of a connector strap of an apparatus for modifying shipping containers in accordance with an embodiment of the present invention.

The present invention relates generally to shipping containers. Specifically, embodiments of the present invention are directed towards an apparatus for enabling two non-standard shipping containers to be interconnected to form a standard shipping container.

According to an embodiment of the present invention, an apparatus for modifying shipping containers shipping container. In a preferred embodiment, the modifiable shipping container is comprised of a shipping container, a connectable end frame, and one or more connector mechanisms. Alternate embodiments of the modifiable shipping container may include fewer or additional components. One of ordinary skill in the art would appreciate there are numerous components that could comprise a modifiable shipping container, and embodiments of the present invention are comprised for use with any such component.

According to a preferred embodiment of the present invention, the components of the modifiable shipping container are primarily comprised of metal. Examples of suitable metals include, but are not limited to, steel, aluminum, titanium, and any appropriate metal alloy. Certain components of the modifiable shipping container, however, may be comprised of plastics, rubber, polymers, and other non-metallic materials. One of ordinary skill in the art would appreciate that there are numerous materials that might be used for the various components of the modifiable shipping container depending upon the use and function of a given component, and embodiments of the present invention are contemplated for use with any such material According to an embodiment of the present invention, the modifiable shipping container may have a connectable end frame, which may also be referred to as an end frame. In a preferred embodiment the connectable end frame has two frame uprights (a first frame upright and a second frame upright), a top cross bar, and a bottom cross bar. The first upright, second upright, top cross bar, and bottom cross bar are rigidly interconnected to form the connectable end frame.

According to an embodiment of the present invention, the connectable end frame has a connection point at each corner of the connectable end frame. In a preferred embodiment, each connection point is a hole or receiver point on the exterior surface of the connectable end frame. The connection point is configured to receive the connector mechanism, which is described in further detail below. In some embodiments, a connection point is located in each corner of the connectable end frame such that when a first non-standard container is lined up with a second non-standard container each containers' connection points are aligned, therefore enabling a connector mechanism to join the two non-standard containers together by linking each container's corresponding connection points. In other embodiments, in addition to the connection points located at each corner of the connectable end frame, there will be further connection points located along portions of both frame uprights, as well as the top cross bar and the bottom cross bar. These connections points will be used for the secondary locking mechanism and the connection flaps, which are described in greater detail below. One of ordinary skill in the art would appreciate there are numerous suitable arrangements and configurations for connection points, and embodiments of the present invention are contemplated for use with any such arrangement or configuration of connection points.

According to an embodiment of the present invention, at least one end panel of each non-standard container can be opened or closed. The container has side walls which are attached to components of an end frame.

According to an embodiment of the present invention, at least one of the frame uprights is modified to include a hinge which is attached to the end panel. The end panel can then swing from the closed position to the open position. When the end panel is moved to the open position it can be attached to the side wall via any appropriate latching mechanisms.

According to an embodiment of the present invention, the hinge attaching the end panel to the frame may take different structural forms to ensure that the end panel can be rotated safely and easily from a closed position to an open position and vice versa. Also, the frame may be reinforced to hold the hinge securely and to handle the weight and forces of the end panel as it is rotates about the frame upright. Consequently, when practicing the invention, the frame for a standard ISO ocean shipping container is removed and replaced with a frame modified in accordance with the invention. The end panel is generally made of a sturdy corrugated metal but any known suitable end panel may be used instead.

According to an embodiment of the present invention, the components of the end frame are constructed to be sturdy so as to handle the load associated with the end panel and the need to rotate it and also to enable two non-standard containers to be securely mated to each other to from one standard container. In some embodiments of the invention, a rubber tubing may be attached to the exterior portions of the frames, particularly to the two frame uprights and the top cross bar.

According to an embodiment of the present invention, the end frame for holding an end panel may include cleats. In a preferred embodiment, the cleats may be small trapezoidal protrusions that extend from the bottom frame and rest against the end panel. The cleats may be mounted along the top and bottom cross bars of the end frame. So formed, the end frame can hold an end panel securely. At the same time, the panel can be easily unlatched. A latch within the frame can be unlocked from the inside by releasing the latch by hand. The panel can then be swung open by a single person via a hinge (or a set of hinges), and can be latched to the inside of a side wall of the container. When the end panel of a first container is opened and the end panel of a second container is also opened, the two containers can be positioned end to end so that the first container can be connected to the second container to form one standard container.

Figure 3:
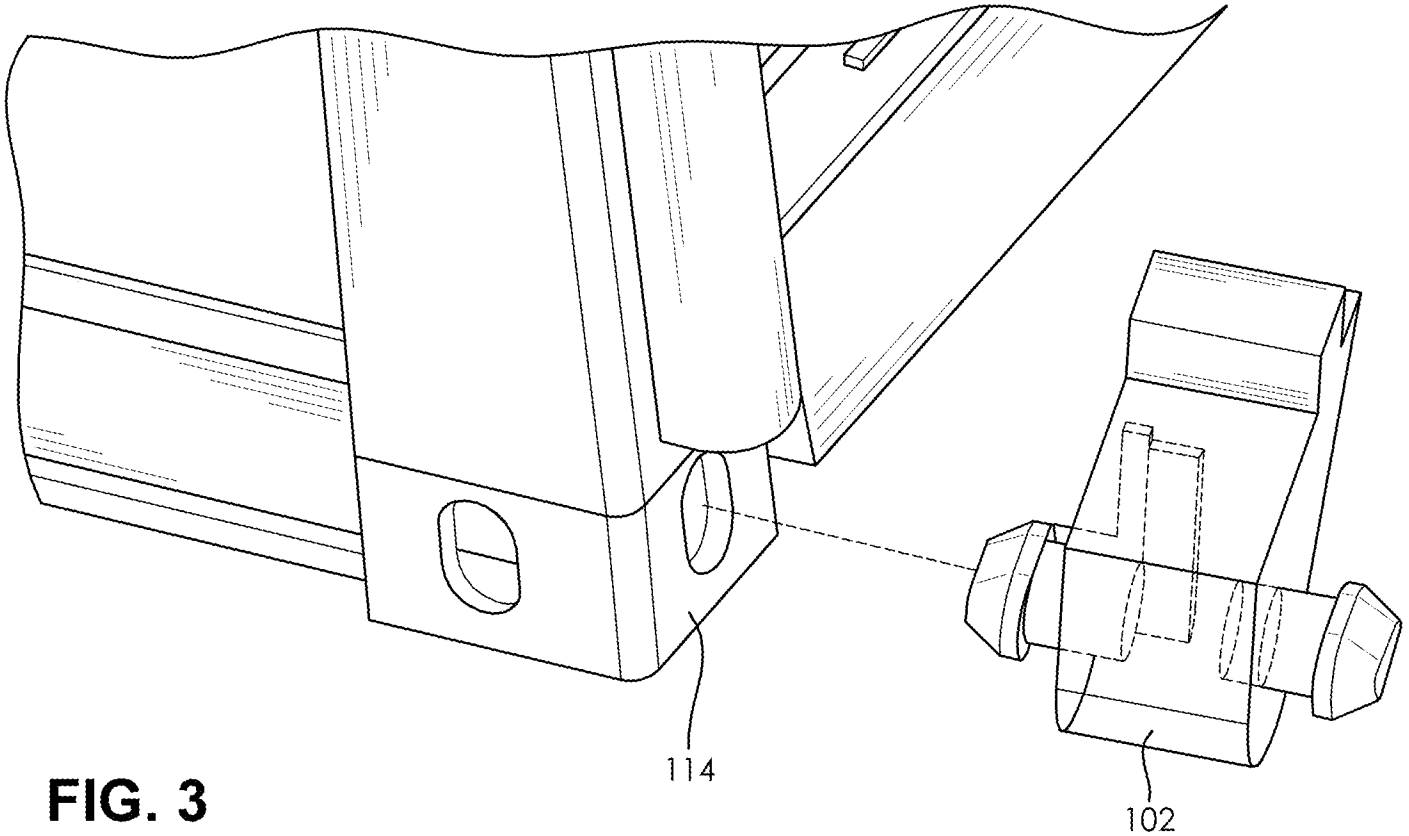
FIG. 3 is a perspective view of a twist-lock apparatus and connection point of an apparatus for modifying shipping containers in accordance with an embodiment of the present invention.

According to an embodiment of the present invention, a first non-standard container may be connected to a second non-standard container by using a connector mechanism. In some embodiments, the connector mechanism is a twist-lock apparatus as shown in FIG. 3. In a preferred embodiment, the twist-lock apparatus comprises two shafts extending outwards from opposite sides of the main body of the twist-lock apparatus and terminating in two knob-like structures. In the preferred embodiment, the knob-like structure detachably engages with a connection point located on the end frame of a container. One of ordinary skill in the art would appreciate there are many suitable designs for a twist-lock apparatus, and embodiments of the present invention are contemplated for use with any such design.

According to an embodiment of the present invention, the present invention includes a connector mechanism which fastens and holds together the adjacent ends of non-standard shipping containers so that the resultant container is the standard forty (40) feet in length. According to one embodiment, there would be one connector mechanism for each frame corner for a total of four (4) connector mechanisms interconnecting two non-standard containers to form one standard shipping container.

According to an embodiment of the present invention, the connector mechanism is a connector strap. In a preferred embodiment, the connector strap is primarily a rectangular shaped bar with a twist-lock apparatus located at each end of the bar, as shown in FIG. 1. In the preferred embodiment, the connector strap detachably simultaneously engages with two separate connection points located on the end frame of a container. As an illustrative example, a connector strap could reversibly engage with the connection points located at each end of the top cross bar of the end frame of a first non-standard shipping container. The connector strap could then be used to connect a second non-standard shipping container to the first non-standard shipping container whereby the connector strap facilitates a connection between the top cross bar of the first container and the top cross bar of the second container. In the same example, this process could be repeated with a second connector strap that connects the bottom cross bar of the first container with the bottom cross bar of the second container. As an alternate example, a connector strap could be used to connect a first non-standard shipping container to a second non-standard shipping container by connecting the two containers along the first and second frame uprights of each container. One of ordinary skill in the art would appreciate there are many suitable designs and connection methods for a connector strap, and embodiments of the present invention are contemplated for use with any such design or connection method.

According to an embodiment of the present invention, the connector strap may be configured with a secondary locking mechanism. In a preferred embodiment, the secondary locking mechanism is configured in the middle portion of the connector strap. In the preferred embodiment, the secondary locking mechanism is comprised of two pairs of locking hooks, with each pair of the locking hooks extending from opposite sides of the body of the connector strap and on the same plane as the twist-lock mechanisms. The locking hooks of the secondary locking mechanism reversibly engage with connection points located on the top and bottom cross bars of the end frame. One of ordinary skill in the art would appreciate there are numerous suitable designs for a secondary locking mechanism, and embodiments of the present invention are contemplated for use with any such design.

According to an embodiment of the present invention, the secondary locking mechanism may further include a locking hook engagement handle. In a preferred embodiment, the locking hook engagement handle is configured to connect to components of the secondary locking mechanism that are located in the internal portions of the connector strap. In the preferred embodiment, the locking hook engagement handle is configured to fasten the locking hooks to and release the locking hooks from the connection points located on the portions of the end frame. As an illustrative example, moving the locking hook engagement handle in one direction will cause the locking hooks to firmly connect to connection points on the end frame. Correspondingly, moving the locking hook engagement handle in the opposite direction will cause the locking hooks to release from the connection points on the end frame. One of ordinary skill in the art would appreciate there are numerous suitable configurations for a locking hook engagement handle, and embodiments of the present invention are contemplated for use with any such configuration.

According to an embodiment of the present invention, the connector strap may be configured with a liquid diverting system. In a preferred embodiment, the liquid diverting system is comprised of a liquid diverting ledge and a liquid draining slit. In alternate embodiments, the liquid diverting system may comprise fewer or additional components. One of ordinary skill in the art would appreciate that there are many designs for a liquid diverting system, and embodiments of the present invention are contemplated for use with any such design.

According to an embodiment of the present invention, the liquid diverting system may include a liquid diverting ledge. In a preferred embodiment, the liquid draining ledge is a projection that runs along the main body of the connector strap on the same face as the twist-lock apparatus. In the preferred embodiment, the liquid draining ledge diverts water and other fluids to the ends of the connector strap and away from the insides of the container. One of ordinary skill in the art would appreciate that there are many designs for a liquid diverting ledge, and embodiments of the present invention are contemplated for use with any such design.

According to an embodiment of the present invention, the liquid diverting system may include a liquid draining slit. In a preferred embodiment, the liquid draining slit is an opening on the left and right ends of the body of the connector strap. In the preferred embodiment, the liquid draining slit allows any water or fluid that may be trapped inside of the body of the connector strap to be purged. One of ordinary skill in the art would appreciate that there are many designs for a liquid draining slit, and embodiments of the present invention are contemplated for use with any such design.

According to an embodiment of the present invention, the apparatus for modifying shipping containers shipping container may include a one or more connection flaps. In a preferred embodiment the connection flap is a collapsible or foldable panel that is permanently attached to a frame upright of the end frame of a first non-standard shipping container and reversibly engages with a frame upright of the end frame of a second non-standard shipping container. As an illustrative example, a first non-standard shipping container has a connection flap permanently attached to its first frame upright and a second non-standard shipping container has a connection flap permanently attached to its first frame upright. When the first non-standard shipping container is attached to the second non-standard shipping container, the connection flap of the first non-standard shipping container will connect to connection points on the second frame upright of the second non-standard shipping container. Correspondingly, the connection flap of the second non-standard shipping container will connect to connection points on the second frame upright of the first non-standard shipping container. This connection further secures the two non-standard shipping containers together. In alternate embodiments, the connection flap may not be permanently attached to a frame upright of a container, but instead be independent of the frame upright and reversibly connect the corresponding frame uprights of two separate non-standard shipping containers. One of ordinary skill in the art would appreciate there are many suitable designs and connection methods for a connection flaps, and embodiments of the present invention are contemplated for use with any such design or connection method.

According to an embodiment of the present invention, the connectable end frame may be configured with a floor extension plate. In a preferred embodiment, the floor extension plate is configured to be hinged and fold out from on or near the top of the bottom cross bar. In the preferred embodiment, the floor extension plate is provided to extend between the floors of two interconnected non-standard shipping containers to ensure that there is a smooth surface to permit wheeled vehicles to travel smoothly between the two non-standard shipping containers. When the floor extension plates are deployed on both of the connected containers, the plates form smooth surfaces which wheeled utility vehicles can easily move over. One of ordinary skill in the art would appreciate there are numerous suitable configurations for floor extension plates, and embodiments of the present invention are contemplated for use with any such configuration.

According to an embodiment of the present invention, in order to maintain waterproofing, rubber tubing may be installed along the connectable end frame to allow water to be kept out and drained to the side when two containers are connected. In the preferred embodiment, the rubber tubing is hollow and can be removed and replaced when damaged. This insulation is part of connectable end frame, and no action needs to be done during the connection or disconnection of the two containers.

Exemplary Embodiment

Figure 7:
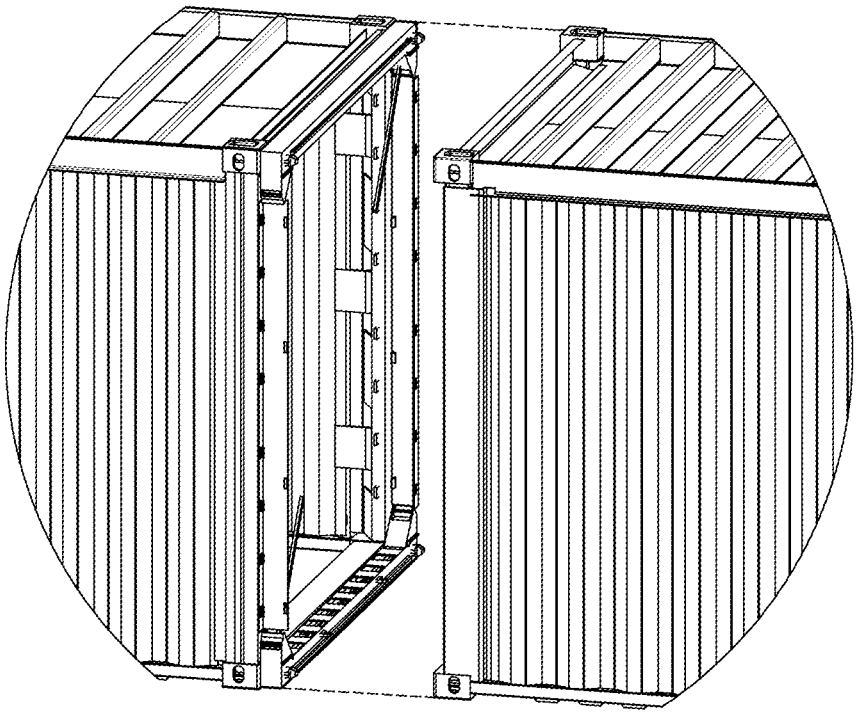
FIG. 7 is an illustration of two non-standard shipping containers being connected together in accordance with an embodiment of the present invention.
Figure 8:
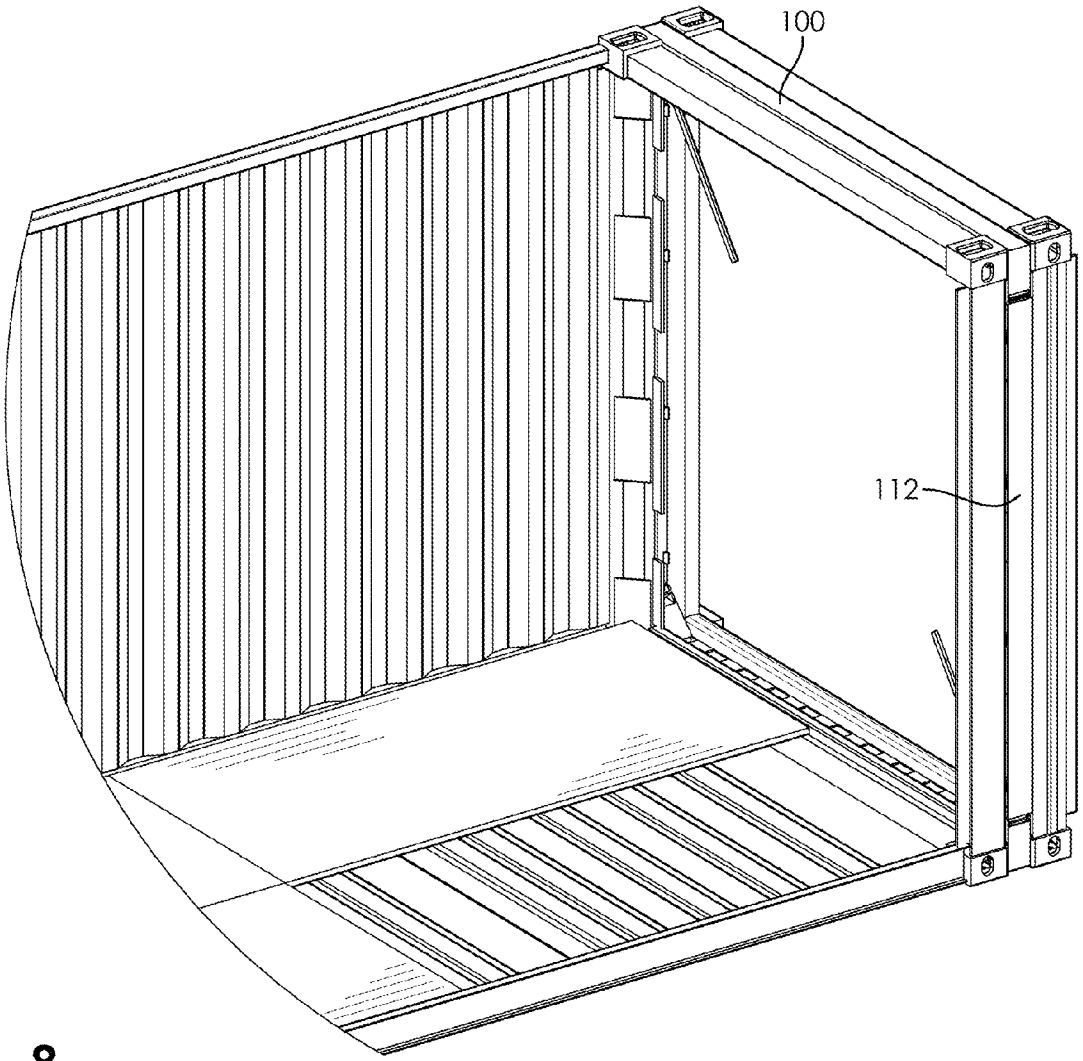
FIG. 8 is a cut-away view of a connector strap in place between a first shipping container and a second shipping container in accordance with an embodiment of the present invention.
Figure 9:
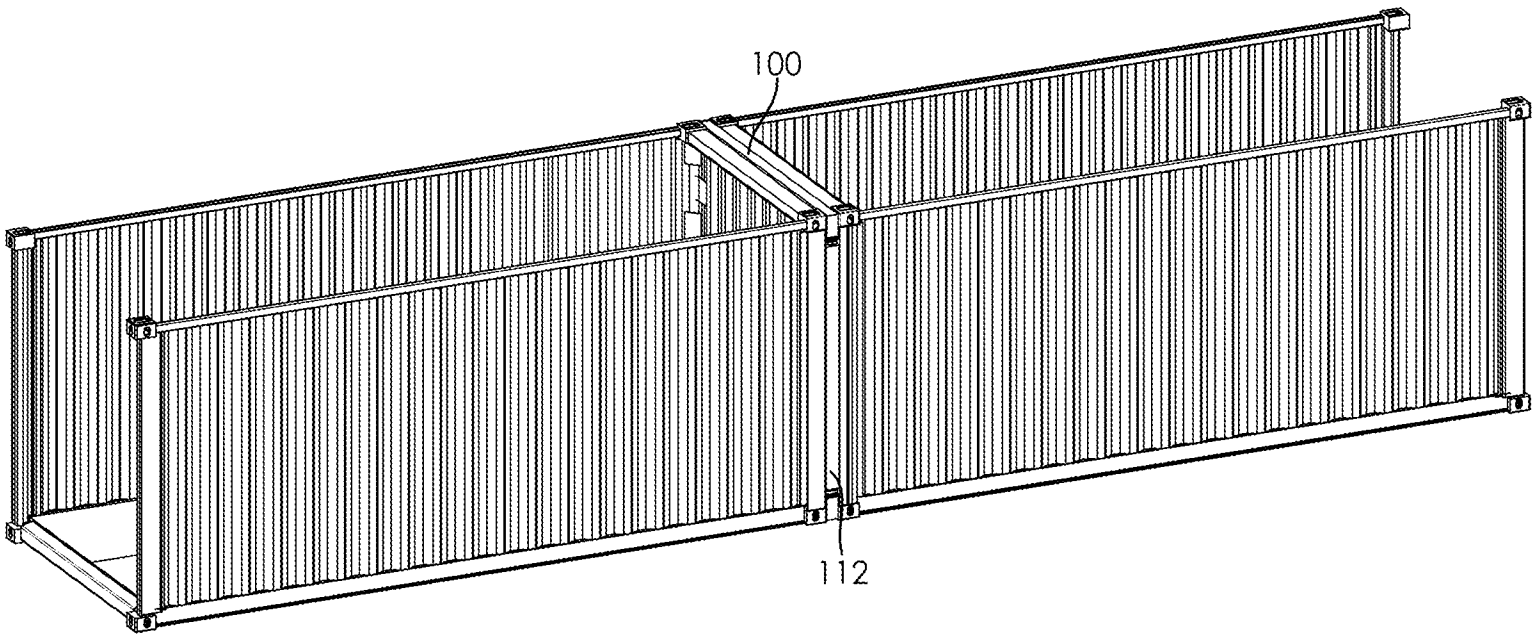
FIG. 9 is an illustration of two non-standard shipping containers connected together by a connector strap in accordance with an embodiment of the present invention.
Figure 10:
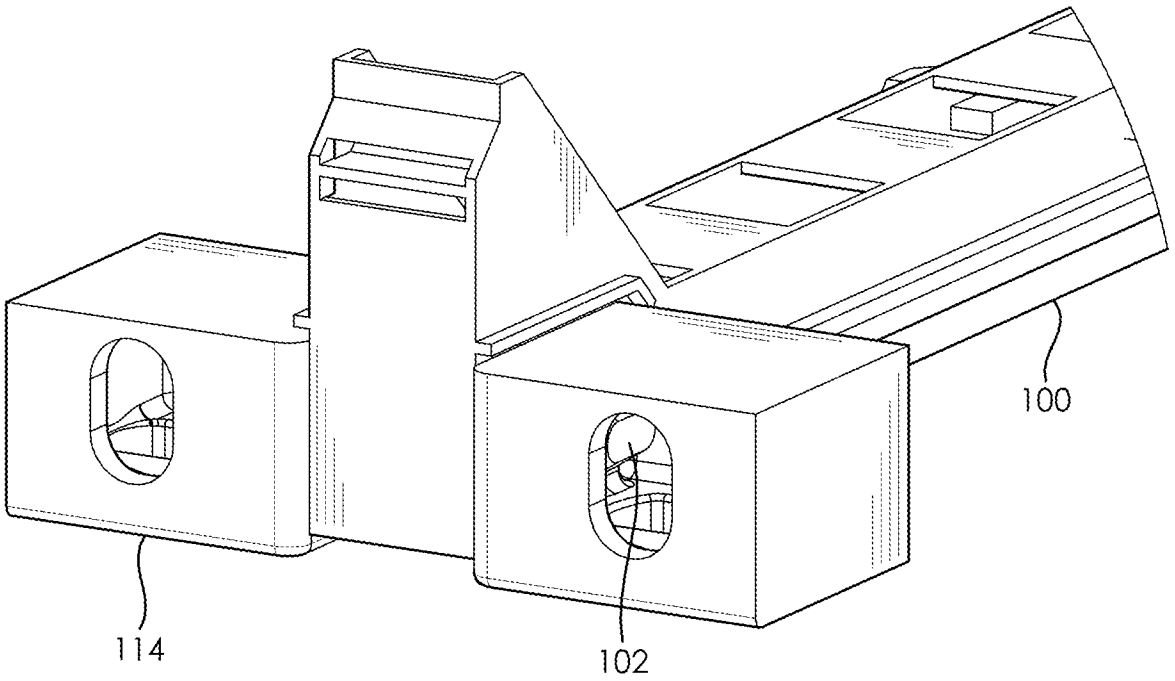
FIG. 10 is an illustration of a twist-lock apparatus of a connector strap engaged with a connection point of an apparatus for modifying shipping containers in accordance with an embodiment of the present invention.

According to an embodiment of the present invention, after the back (or front) panel of a non-standard shipping container is opened, connector mechanisms, may be installed in the corner connection points of the connectable end frames of two non-standard shipping containers that are to be together as shown in FIGS. 7, 8, and 9. By way of example, as shown in FIG. 10, the knobs of the twist-lock apparatus inserted into the connection points on corresponding frame corners and then the connector mechanism securely holds the frames of the two non-standard shipping containers together. The knobs of the twist-lock apparatus prevent the separation of the adjoining frames.

According to an embodiment of the present invention, a first non-standard shipping container may be connected to a second non-standard shipping container by using a connector mechanism. In some embodiments, a connector mechanism or any other suitable connector may be stored within each non-standard shipping container near the frame at the back or front end.

Referring to FIG. 7, note that the end of a first container is facing the end of second container. The two non-standard shipping containers to be mated are arranged to be complementary to each other. The connectable end frames of the two non-standard shipping containers is the same with the frame uprights of the first container facing the uprights of the second container and the top and bottom cross bars of the first container corresponding to the top and bottom cross bars of the second container.

The connector mechanism can attach to the frame uprights through a twist-and-lock apparatus, whereby a connector mechanism is inserted into one of the corners of the end frame uprights and twisted so that is locked into position. This allows a first non-standard shipping container to be attached to a second non-standard shipping container to form a container that is of equivalent size to standard container. The design of the actual contact between the connector and the container corners may make use of any suitable design.

When it is desired to join two non-standard shipping containers, the end of a first container is aligned with the end of a second container. The two containers are connected together using connector mechanisms that hold the containers together in a spaced relationship. The connector mechanisms may be positioned at each corner of the end frames located at ends of the two non-standard shipping containers. Alternatively, the connector mechanisms may be positioned at any other suitable point along the frames. The width of the connector mechanisms provides the proper spacing between the two containers to create the same dimensions of a standard container. It will be up to the operator as to the method used to properly align the two containers. Existing technologies, such as ISO container casters, ISO container carts, or container handling machinery, can easily be adapted to handle the positioning of the containers.

To disconnect two joined non-standard shipping containers, a few steps are necessary. First, the containers may be placed on a mechanism similar to the one used to align the two containers when they were joined. The connector mechanisms joining the two containers can be twisted outward using a tool or by hand. The two containers can then be separated. An operator can enter each container and store one of the connector mechanisms in the first container and the other connector mechanism in the second container. Next, the connection flaps can be disengaged and folded back into the stowed position. Then, the end panel will be unlatched from the side wall, and swung back to the closed position. Finally, the interior latch will be engaged by the operator to lock the end panel into place.

Turning now to FIG. 1, a perspective view of a connector strap 100, in accordance with an embodiment of the present invention. In this illustration, a preferred embodiment of the connector strap 100 is shown with a twist-lock apparatus 102 at each end of the of connector strap 100. The preferred embodiment of the connector strap 100 also includes a secondary locking mechanism that is comprised of a pair of locking hooks 104 and a locking hook engagement handle 106. The preferred embodiment of the connector strap 100 may also include a liquid diverting system that is comprised of a liquid diverting ledge 108 and liquid draining slit 110.

Figure 2:
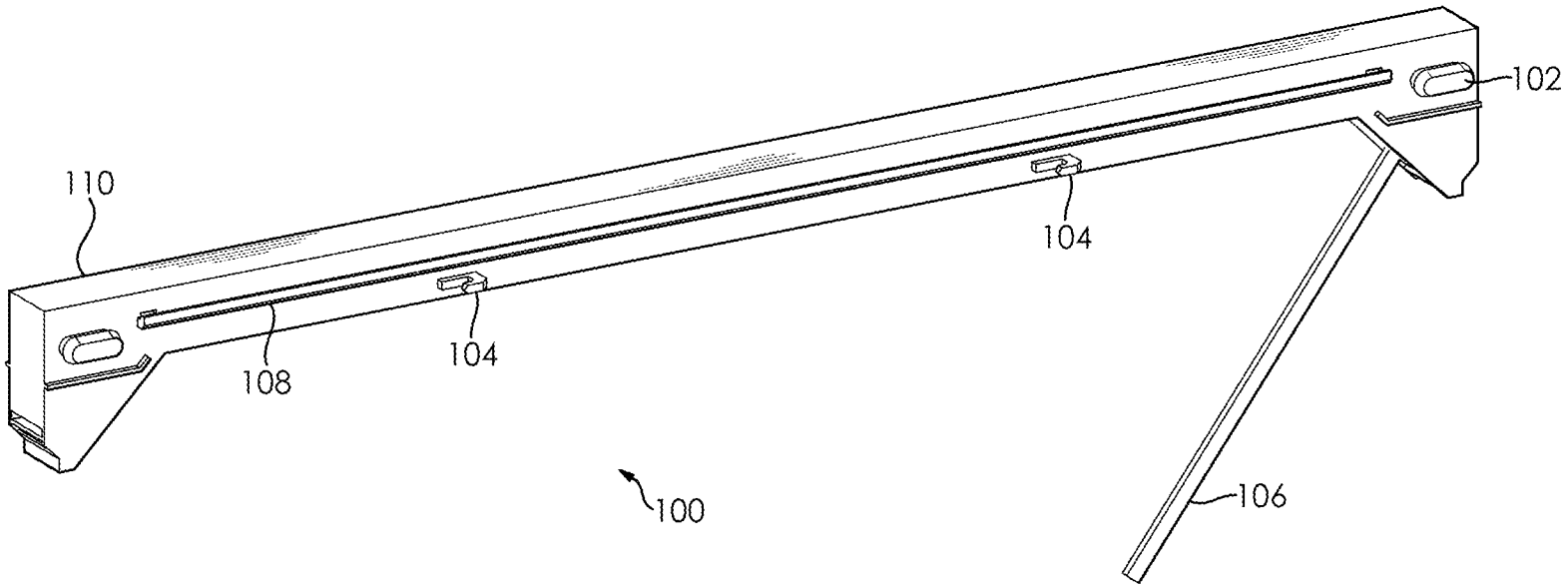
FIG. 2 is an alternate perspective view of a connector strap of an apparatus for modifying shipping containers in accordance with an embodiment of the present invention.

Turning now to FIG. 2, an alternate perspective view of a connector strap 100, in accordance with an embodiment of the present invention. In this illustration, a preferred embodiment of the connector strap 100 is shown with a twist-lock apparatus 102 at each end of the of connector strap 100. The preferred embodiment of the connector strap 100 also includes a secondary locking mechanism that is comprised of a pair of locking hooks 104 and a locking hook engagement handle 106. The preferred embodiment of the connector strap 100 may also include a liquid diverting system that is comprised of a liquid diverting ledge 108 and liquid draining slit 110.

Turning now to FIG. 3, an illustration of a twist-lock apparatus 102 and a connection point 114 of an apparatus for modifying shipping containers in accordance with an embodiment of the present invention. In this illustration, a close-up view of a twist-lock apparatus 102 being aligned with a connection point 114 is shown.

Figure 4:
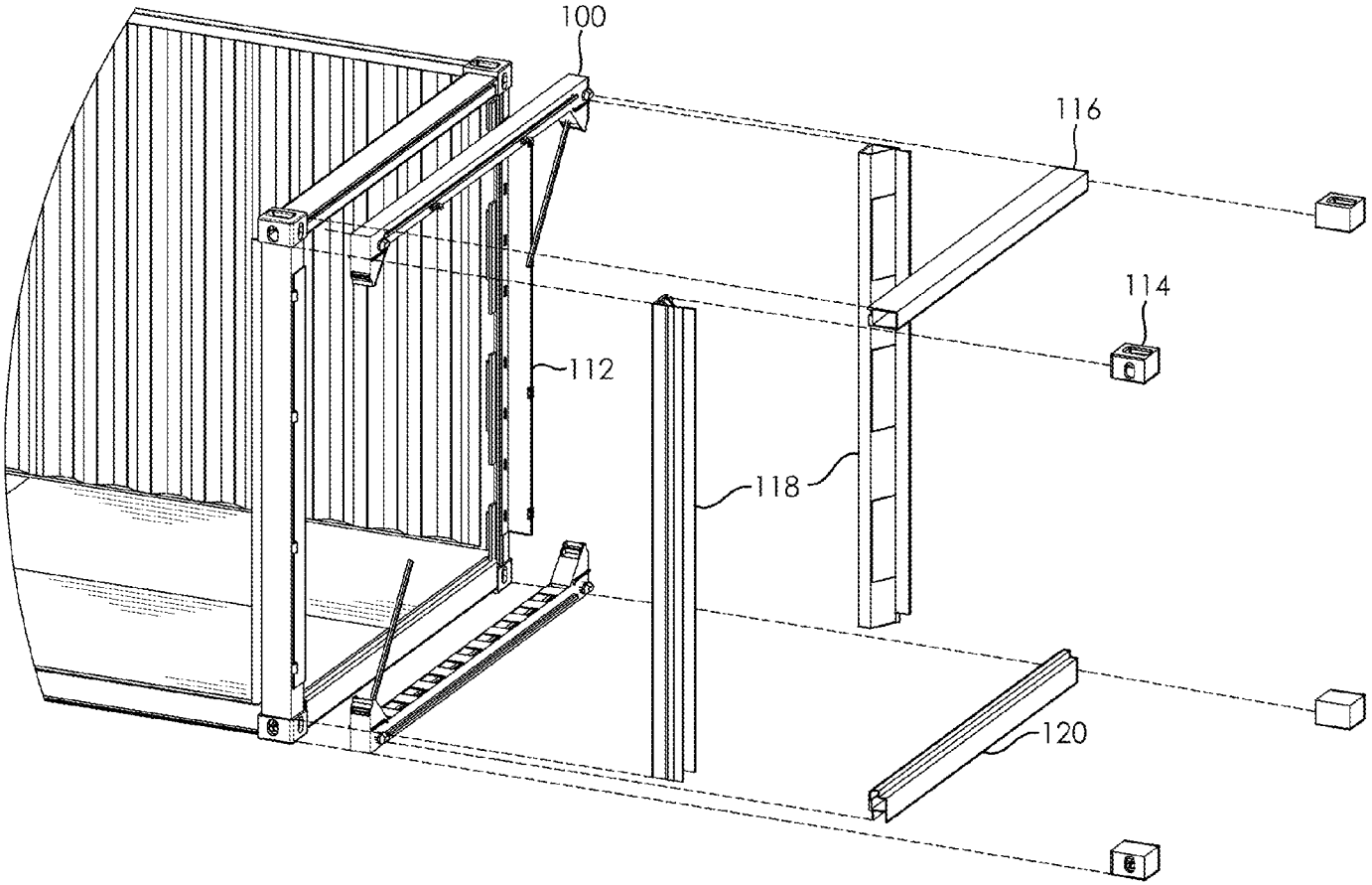
FIG. 4 is a an exploded view of the components of a connectable end frame of an apparatus for modifying shipping containers in accordance with an embodiment of the present invention.

Turning now to FIG. 4, an exploded view of the components of a connectable end frame of an apparatus for modifying shipping containers in accordance with an embodiment of the present invention. In this illustration, a preferred embodiment of a connectable end frame is shown, with a top cross bar 116, frame uprights 118, and a bottom cross bar 120. The connectable end frame also includes connection points 114 that the connector strap 100 can engage with. In some embodiments, the apparatus for modifying shipping containers may include connection flaps 112.

Figure 5:
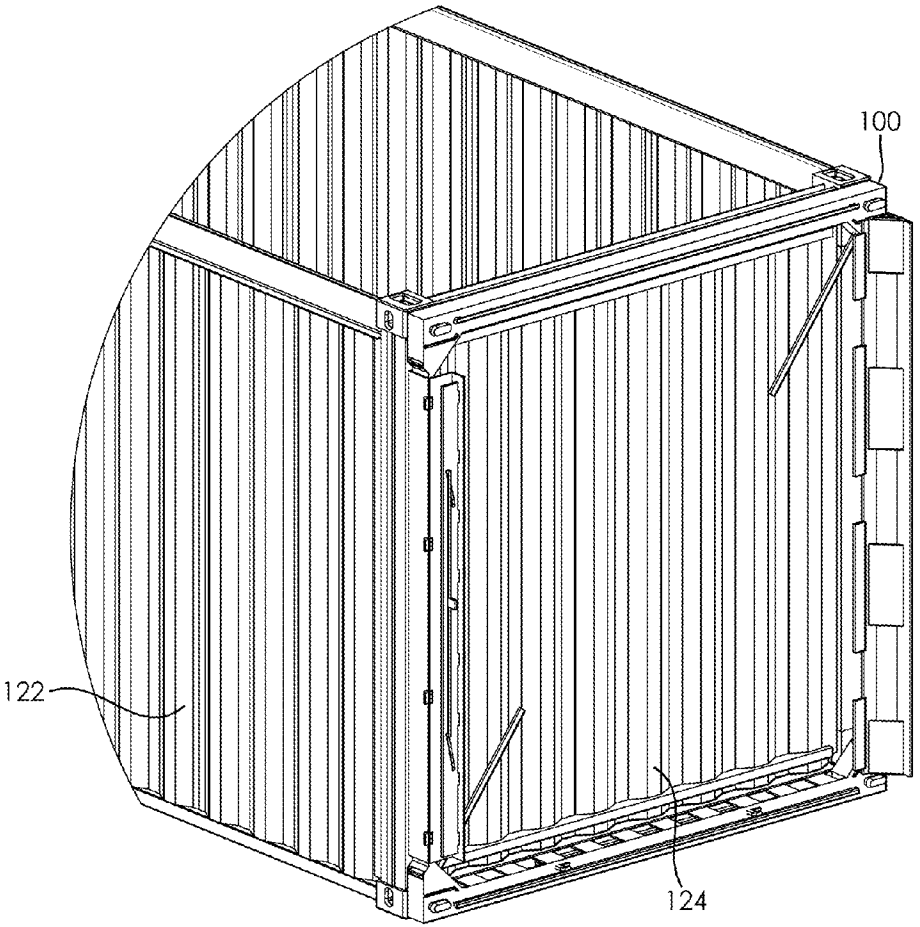
FIG. 5 is an illustration of connector straps in place at the top and bottom cross bars of a connectable end frame of a shipping container in accordance with an embodiment of the present invention.

Turning now to FIG. 5, an illustration of connector straps 100 in place at the top and bottom cross bars of a connectable end frame of a shipping container 122 in accordance with an embodiment of the present invention. In this illustration, the end panel 124 is shown in a closed position.

Figure 6:
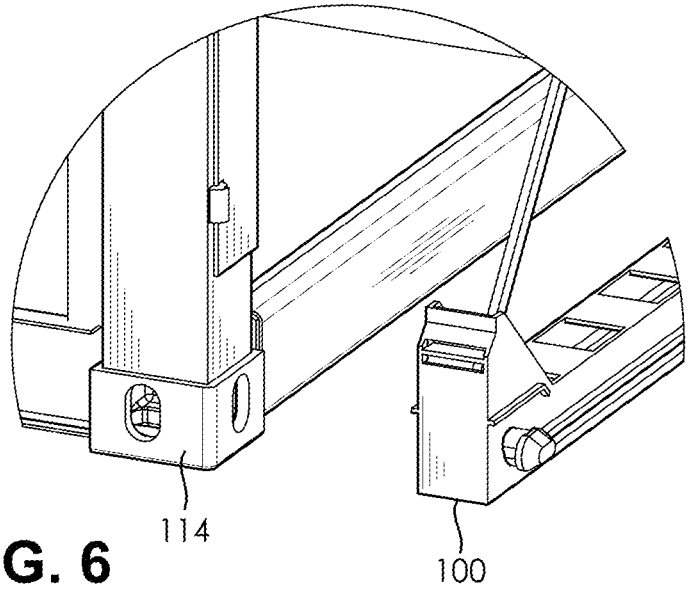
FIG. 6 is a zoomed-in view of a connector strap and a connection point of an apparatus for modifying shipping containers in accordance with an embodiment of the present invention.

Turning now to FIG. 6, an illustration of a connector strap 100 and a connection point 114 of an apparatus for modifying shipping containers in accordance with an embodiment of the present invention. In this illustration, a close-up view of a connector strap 100 being aligned with a connection point 114 is shown.

Turning now to FIG. 8, an cut-away illustration of a connector strap 100 connecting the connectable end frames of two non-standard shipping containers in accordance with an embodiment of the present invention. In this illustration, the connector strap 100 and connection flap 112 are shown connecting the frames of the frames of the two containers.

Turning now to FIG. 10, an illustration of a twist-lock apparatus 102 of a connector strap 100 engaged with a connection point 114 in accordance with an embodiment of the present invention. In this illustration, the knob of the twist-lock apparatus 102 is shown to be engaged with the hole of a connection point 114, therefore allowing the connector strap 100 to securely join to non-standard shipping containers.

Figure 11:
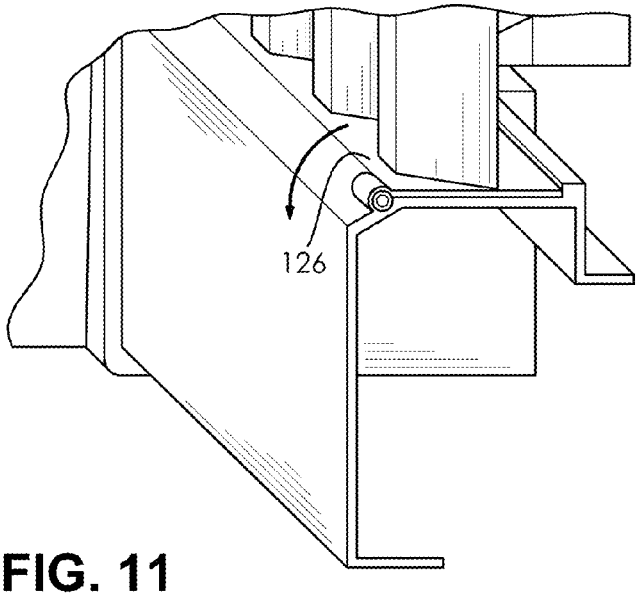
FIG. 11 is an illustration of a floor extension plate in a closed position in accordance with an embodiment of the present invention.
Figure 12:
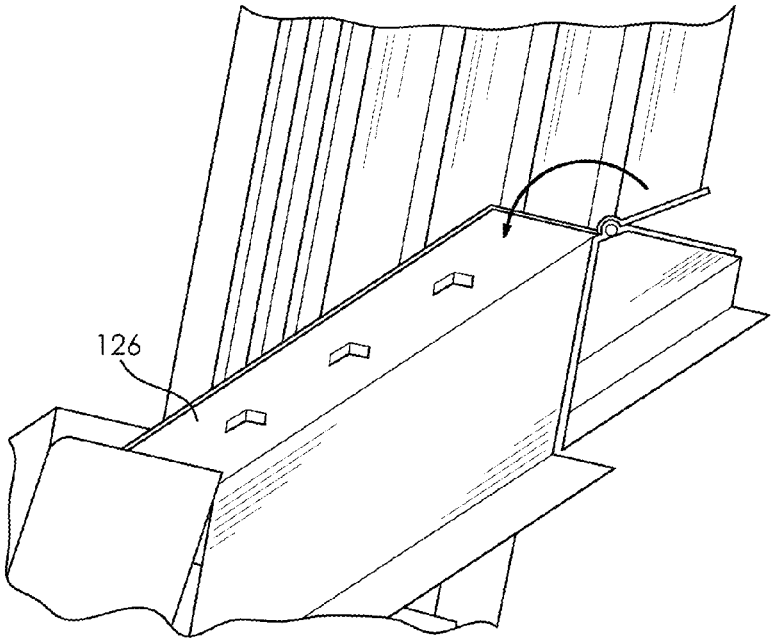
FIG. 12 is an illustration of a floor extension plate in an extended position in accordance with an embodiment of the present invention.

Turning now to FIGS. 11-12 is an illustration of a floor extension plate 126 in accordance with an embodiment of the present invention. In FIG. 11 the floor extension plate is in a closed position folded over against the bottom cross bar of the connectable end frame. In FIG. 12 the floor extension plate 126 is in an extended position, thereby creating a flat and continuous floor between two connected non-standard shipping containers.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. An apparatus for modifying shipping containers, said apparatus comprising:

a connectable end frame, comprising a top cross bar, a first frame upright, a second frame upright, and a bottom cross bar, wherein said top cross connects the top of said first frame upright to the top of said second frame upright, wherein said bottom cross bar connects the bottom of said first frame upright to the bottom of said second frame upright, wherein said connectable end frame is configured with one or more connection points; and one or more connector strap, comprising of a liquid diverting system, wherein each of said one or more connector strap reversibly engages with one or more of said one or more connection points, wherein said liquid diverting system is comprised of a liquid draining slit.

2. The apparatus of claim 1, further comprising one or more connection flaps, wherein said one or more connection flaps are used to connect a first frame upright and a second frame upright of a first shipping container to a first frame upright and a second frame upright of a second shipping container.

3. The apparatus of 1, wherein said one or more connector strap comprises of a twist-lock apparatus.

4. The apparatus of claim 1, wherein in said one or more connector strap is further comprised of a secondary locking mechanism.

5. The system of claim 4, wherein said secondary locking mechanism is further comprised of one or more locking hooks.

6. The system of claim 4, wherein said secondary locking mechanism is further comprised of a locking hook engagement handle.

7. The apparatus of claim 1, wherein said liquid diverting system is further comprised of a liquid diverting ledge.

8. The apparatus of claim 1, wherein said connectable end frame further comprises of rubber tubing attached to one or more of said first frame upright, said second frame upright, said top cross bar and said bottom cross bar.

9. The apparatus of claim 1, wherein one or more hinges for an end panel is attached to one or more frame uprights selected from a group of frame uprights comprising said first frame upright and said second frame upright.

10. The apparatus of claim 1, wherein said bottom cross bar of said connectable end frame is further configured with a floor extension plate.

* * * * *